United States Patent [19]

King et al.

[11] 4,195,468

[45] Apr. 1, 1980

[54] METHOD AND APPARATUS FOR USE IN THE ASSEMBLY OF OPTICAL CABLES

[75] Inventors: Frederick D. King, Smiths Falls; Tomasz S. Swiecicki, Kanata, both of Canada

[73] Assignee: Northern Telecom Limited, Montreal, Canada

[21] Appl. No.: 5,094

[22] Filed: Jan. 22, 1979

[51] Int. Cl.[2] ..... D02G 3/44; D01H 13/04

[52] U.S. Cl. ..... 57/9; 57/293; 57/352

[58] Field of Search ..... 57/1 R, 3, 6, 9, 11, 57/12, 13, 17, 18, 204, 293, 352

[56] References Cited

U.S. PATENT DOCUMENTS

| | | | |
|---|---|---|---|
| 2,258,687 | 10/1941 | Peterson | 57/3 X |
| 2,501,074 | 3/1950 | Thelin | 57/9 X |
| 2,825,260 | 3/1958 | O'Brien | 57/248 X |
| 3,091,074 | 5/1963 | Demmel | 57/293 X |
| 3,187,495 | 6/1965 | Christian | 57/293 |
| 4,154,049 | 5/1979 | King et al. | 57/9 |

*Primary Examiner*—Donald Watkins
*Attorney, Agent, or Firm*—Sidney T. Jelly

[57] ABSTRACT

An optical cable is assembled by inserting dielectric optical waveguides into periodically reversing helical grooves in the surface of a central filament. The invention is concerned with minimizing longitudinal tension in the waveguides. Powered rollers draw dielectric optical waveguide from fixed reels and delivers it, in a slack condition, to a guide unit which is mounted by means of a thrust bearing. The guide unit supports rods with apertures at their ends through which dielectric optical waveguide is guided, the rod ends being disposed within the grooves so that respective dielectric optical waveguides and grooves are maintained circumferentially coincident. Cable is drawn downstream of the guide unit to pull the filament and dielectric optical waveguides together at the guide unit and also to reciprocally drive the guide unit. As the filament, with dielectric optical waveguides positioned in its grooves, exits the guide unit, it is helically wound with tape.

16 Claims, 5 Drawing Figures

METHOD AND APPARATUS FOR USE IN THE ASSEMBLY OF OPTICAL CABLES

This invention relates to a method and apparatus for use in the assembly of optical cables.

It has been previously proposed to manufacture optical cables having a central strength member of, for example, steel wire, a plastics outer sleeving extruded around the steel wire and a series of grooves formed in the surface of the plastic sleeving, each groove containing a dielectric optical waveguide.

In order to ensure that dielectric optical waveguides are not subject to destructive tensile and compressive stresses whenever the cable is bent, the grooves are made in helical form. Thus, at a curved part of a cable a dielectric optical waveguide experiences alternately compression and tension and over the length of the curve, the stresses at least partially cancel out.

The manufacturing steps for such cable include production of a grooved, plastics coated metal strength member to provide a central filament for the cable, and the laying of dielectric optical waveguides into the grooves in the central filament.

To lay dielectric optical waveguides into an appropriately grooved central filament, a planetary stranding technique has been adopted. In such a tecnhique for laying-in, say ten dielectric optical waveguides, ten reels of dielectric optical waveguide are mounted on a rotatable jig with the central filament being led through the centre of the jig. The reels revolve around the longitudinally moving filament with an angular velocity commensurate with both the pitch of the helical grooves and the velocity of the central filament. In effect therefore a reel follows a groove around as the central filament is fed through the jig. A suitable locating device presses payed out dielectric optical waveguide into the grooves.

Rotation of the reels and their motion around the central filament does, however, introduce a twist into the layed dielectric optical waveguide which is unacceptable because of the internal stresses which result. To compensate for this the reels are themselves rotated so that the undesirable twist in the dielectric optical waveguide is pre-empted. The nature of the movement of the reels somewhat resembles a planet system and accounts for the name given to this technique.

It will be appreciated that a complex servomechanism is required to correctly interrelate the speeds at which:

(i) the central filament is fed through the jig;

(ii) dielectric optical waveguide is payed out;

(iii) the jig is rotated; and (iv) the reels are rotated.

An optical cable structure forming the subject of our co-pending patent application Ser. No. 913,819, U.S. Pat. No. 4,154,049, filed June 8, 1978, permits the simplification of operating techniques for manufacture of optical cable. In the co-pending application there is disclosed a filament for an optical cable, the filament having a grooved surface, the grooves being in the form of helices, each helix changing hand along the filament. Dielectric optical waveguides are layed into the grooves using a cabling technique which is described in a further co-pending patent application Ser. No. 913,657, filed June 8, 1978. Apparatus for use in the technique comprises a plurality of dielectric optical waveguide stores, which can be reels, the stores being fixedly located around a feedpath for the filament, a reciprocally rotatable guide means located radially outwardly of said feedpath for guiding individual dielectric optical waveguides from the stores to respective grooves and a locating device for positioning individual optical waveguides into said grooves. Dimensions of the helices can be so chosen that the periodic change of hand produces no net circulation of a groove around the longitudinal axis of the filament. Clearly, this obviates the need for rotation of the individual dielectric optical waveguide stores or reels.

In a modification of this apparatus, according to the present invention, means are provided for reducing tension in dielectric optical waveguides positioned in said grooves.

Tension in the waveguides of the finished cable is undesirable since it both increases light loss from the waveguides and increases the chance of waveguide fracture.

Preferably the tension reducing means is adapted to introduce an element of slackness in the waveguides positioned within said grooves.

Said tension reducing means can include a drawing mechanism located upstream of the guide means, said drawing mechanism being driveable to draw dielectric optical waveguides from said respective stores and to present such waveguides, in a slack condition, to said guide means.

The drawing mechanism can comprise a pair of horizontal, resilient rollers pressed together to pinch dielectric optical waveguides therebetween. The stores can be reels located close to a vertical plane containing said feedpath, said reels having substantially horizontal rotational axes.

Particularly for use with plastics coated dielectric optical waveguides, said tension reducing means can be an adaptation of said locating means to minimize frictional engagement between said locating means and said dielectric optical waveguides. Thus said guide means can comprise a rotatable support having a central aperture through which the filament is advanced along said feedpath and a first array of bores located radially outwardly of the aperture to loosely receive respective dielectric optical waveguides therein; said locating device can comprise a plurality of rods mounted within respective ones of a second circular array of bores extending through the support, the bores of said second array inclined to the feedpath and radially spaced from said first array, each rod having an aperture at its end to loosely receive a dielectric optical waveguide. This arrangement is particularly adapted for use with plastics coated dielectric optical waveguides since any waveguide coating which is inadvertently stripped as the waveguide passes through the aperture is unlikely to lodge within the aperture, so frictional engagement is minimized.

The tension reducing means can further include a thrust bearing for mounting the rotatable guide means relative to a support structure. Low friction within the bearing is important since only a small moment is available to turn the guide means, this being provided by interengagement of the locating means within the filament grooves downstream of the bearing.

The apparatus can further include tape winding means for winding tape helically around the filament as the filament exits from said guide means. Although the tape winding means primarily functions to maintain dielectric optical waveguides within their associated grooves, frictional engagement between the dielectric optical waveguides and surrounding tape can provide a multiplicity of anchor points for the dielectric optical waveguides downstream of said guide means.

An embodiment of the invention will now be described by way of example with references to the accompanying drawings, in which.

Figures 1, 2, 3, 4, 5:
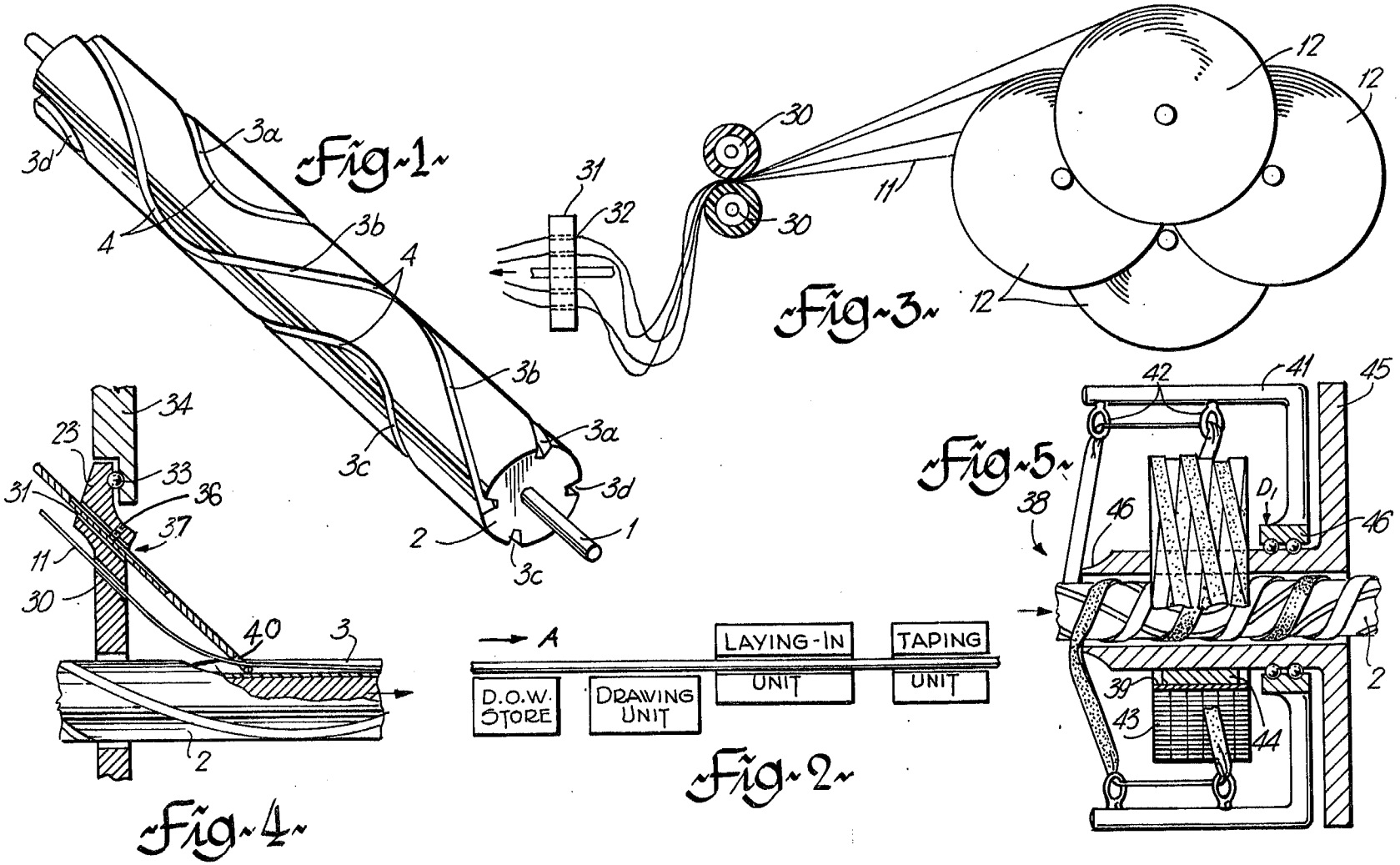
FIG. 1 is a perspective view of a length of filament for use in the fabrication of an optical cable.
FIG. 2 is a schematic representation of part of a cabling process for the fabrication of the optical cable.
FIG. 3 is a perspective view of a device for drawing dielectric optical waveguide from reels and delivery it to a laying-in unit.
FIG. 4 is a part sectional view of a mechanism for laying dielectric optical waveguide into grooves in the filament.
FIG. 5 is a part sectional view of a mechanism for taping dielectric optical waveguides to the grooved filament.

Referring to the drawings in detail, a filament for an optical cable has a central steel wire strength member 1 and, extruded over the strength member 1, a sleeve 2 of high density polyethylene. Formed in the surface of the sleeve and extending throughout the length of the filament are a number, in this case four, of circumferentially spaced grooves 3*a*, 3*b*, 3*c*, and 3*d*. In use, the grooves each accomodate a dielectric optical waveguide in a relatively loose fit, the whole being surrounded by an extruded plastics sheath (not shown). In order to guard against breakage of dielectric optical waveguides where the optical cable is bent, the grooves are made to follow a helical path around the longitudinal axis of the filament. However, as shown at positions 4, the various helical paths followed by the grooves change hand (left to right or right to left) or lay direction. The grooves 3 are advantageously distributed evenly around the filament so the changes of hand of the four helical paths take place at the same specific positions along the length of the filament. The grooves thus have a generally parallel disposition relative to one another. As is evident from FIG. 1, the changes of hand take place at regular intervals along the filament. Turning to FIG. 2, there is shown a schematic representation of cabling apparatus for use with the filament. The filament is pulled in the direction of arrow A past a dielectric optical waveguide store, a drawing unit, and through the centres of a laying-in unit and a taping unit.

As shown in FIG. 3, dielectric optical waveguides are payed out from four reels 12 which are distributed close to the vertical plane containing the feed direction of the filament 2. The dielectric optical waveguides 11 are pulled from the reels by a pair of rollers 30 having slightly resilient surfaces, the rollers being pressed together to pinch the dielectric optical waveguides 11, so that when one of the rollers 30 is driven, the waveguides 11 are drawn from the reels 12. The waveguides on the downstream side of the rollers 30 extend through a fixed plate 31 having distribution holes 32, the waveguides subsequently being led to the laying-in unit shown in greater detail in FIG. 4. The rollers 30 are driven at a speed such that a length of each waveguide hangs between the rollers 30 and the plate 31, the hanging portions of the waveguide preventing undesirable tension from being applied to the waveguides as they are drawn from the plate 31. Without the rollers 30, the tension in the waveguides depends both on the extend to which the reels 12 are balanced and on the friction in the bearings of the reels. Since it is extremely difficult both to maintain a reel permanently in balance, and to equalize the bearing friction of the reels, then, without rollers 30, differential tensile stresses may result in the dielectric optical waveguides of the finished cable.

Downstream of the drawing unit is the laying-in unit, shown in greater detail in FIG. 4. As the cable is pulled (not shown) downstream of the taping unit, filament 2 is consequently pulled through the centre of the laying-in unit and dielectric optical waveguides 11 are pulled through the distribution holes 32 in the fixed plate 31. The dielectric optical waveguides 11 pass through guide means comprising a rotatable plate 23 which is mounted relative a support structure 34 by means of a thrust bearing shown schematically at 33. Rods or needles 37 are mounted in a circular array of holes 31, each of the rods having an aperture 40 at its outer end through which a waveguide 11 is threaded. The rods are inclined towards the axis of the filament 2 with the apertured parts of the rods 37 placed into respective grooves 3. The dielectric optical waveguides run freely through an inner circular array of holes 30 in the plate 23 and are located in the grooves as they pass through the aperture 40. This embodiment is particularly adapted for use with plastics coated dielectric optical waveguides to reduce dynamic friction between the rods and the waveguides and to inhibit build-up of coating which might inadvertently be stripped as a waveguide passes through an aperture.

The rods 37 each have a groove 35 to receive the end of a set screw 36 located in a threaded bore within the plate 23. The position of the rods 37 within the plate can thus be altered to accomodate differently sized filaments.

As shown in FIG. 5, a binding unit 38 which, in use, is located interjacent the laying-in unit 7 and a take-up reel (not shown) has a rotary drum 39 on which thin plastics tape 43, for example Mylar, is double wound. The drum 39 has a friction bearing, represented schematically at 44, relative to a support 45. Independently rotatably mounted, and driven by a drive represented schematically by $D_1$ taken from the laying-in unit, is a stripping device which has a central hub 46, two booms 41 and a pair of rings 42, one ring located generally centrally of the drum and the other ring located upstream of the drum.

As the stripping device is rotated about the axis of filament 2, tape 43 is drawn from the drum 39, which is correspondingly rotated against the friction bearing, the tape being automatically helically wound around the advancing filament 2. To accurately locate the tape, a horn 46 tapers toward a binding position which is just downstream of the laying-in unit. The tape 43 serves to keep the dielectric optical waveguides in place until plastic sheath is applied. This is especially useful if the filament is wound before being sheathed, since, in the wound condition, lengths of the dielectric optical waveguide 11 facing the tape-up reel hub experience a net force tending to eject them from the grooves 3 and this tendency is arrested by the binding tape 39. As mentioned previously the tape where it frictionally engages dielectric optical waveguide provides a multiplicity of anchor points to inhibit tension from being applied to dielectric optical waveguides once they have been layed in their respective grooves.

The reduction in rotating friction of the plate 23 provided by the thrust bearing 33 is important since only a small moment is available to turn the plate 23, this being provided by the interengagement of the rods 37 whose ends follow the movement of grooves 3 in the filament 2.

Other features of apparatus for laying dielectric optical waveguide into the FIG. 1 filament is described in our previously mentioned co-pending patent application Ser. No. 913,657, filed June 8, 1978, to which reference can usefully be made.

What is claimed is:

1. Apparatus for laying dielectric optical waveguide into a filament to produce an optical cable, said filament having a surface defining a plurality of grooves, the grooves each having the form of a helix, each said helix changing hand along the filament, the apparatus comprising a plurality of dielectric optical waveguide stores fixedly located around a feedpath for the filament, a reciprocally rotatable guide means located radially outwardly of said feedpath for guiding individual dielectric optical waveguides from respective stores to respective grooves and a locating device for positioning individual dielectric optical waveguides into said grooves, the apparatus further comprising means for inhibiting introduction of tension in the dielectric optical waveguides as they are positioned in said grooves.

2. Apparatus as claimed in claim 1 wherein said tension inhibiting means comprises a drawing mechanism located intermediate said stores and said guide means, said drawing mechanism being driveable to draw dielectric optical waveguides from said stores and to present such waveguides, in a slack condition, to said guide means.

3. Apparatus as claimed in claim 2, in which said drawing mechanism comprises a pair of generally horizontal, resilient rollers pressed together to pinch dielectric optical waveguides therebetween.

4. Apparatus as claimed in claim 3, in which said stores are reels located close to a vertical plane containing said feedpath, said reels having substantially horizontal rotational axes.

5. Apparatus as claimed in claim 1, in which said tension inhibiting means comprises an adaptation of said locating means to reduce frictional engagement between said locating means and said dielectric optical waveguides, said guide means comprising a rotatable support having a central aperture through which the filament is advanced, said support having a first array of bores located radially outwardly of the aperture to loosely receive respective dielectric optical waveguides therein, said locating means comprising a plurality of rods mounted within respective ones of a second circular array of bores extending through the support, the bores of said second array inclined to the feedpath and radially spaced from said first array, said adaptation comprising outer ends of the rods located in respective grooves being apertured to loosely receive respective dielectric optical waveguides.

6. Apparatus as claimed in claim 5, further comprising fixture means associated with each of said second bores to maintain the rods at predetermined positions within the bores.

7. Apparatus as claimed in claim 6, in which each said fixture means comprises a set screw mounted within the support, and a groove extending along an associated rod, said screw adapted to locate within the groove to clamp the rod within a respective bore.

8. Apparatus as claimed in claim 1, in which said tension inhibiting means comprises a thrust bearing mounting said guide means within a fixed support structure.

9. Apparatus as claimed in claim 1, in which said tension inhibiting means comprises a tape winding mechanism for winding tape helically around the filament, and dielectric optical waveguides positioned therein, as the filament exits from said guide means.

10. Apparatus as claimed in claim 9, in which said tape winding mechanism comprises a hollow rotatable reel on which such tape is wound, and a stripping device rotatable about said reel to strip tape from the reel and to apply stripped tape as a helical binding to the filament as it is advanced through the hollow reel.

11. Apparatus as claimed in claim 10, in which said reel is mounted for rotation against a friction bearing.

12. Apparatus as claimed in claim 11, in which drive to said stripping device is taken from said guide means.

13. Apparatus as claimed in claim 12, in which said stripping device includes a hub and a boom located radially outwardly of said hub, said boom having eyes integral therewith through which eyes tape is pulled from said reel by rotation of the stripping device.

14. Apparatus as claimed in claim 13, in which said tape is double wound on the reel and said stripping device has a pair of radially opposed booms.

15. Apparatus as claimed in claim 14, further including a member mounted concentrically about said feedpath and located interadjacent said guide and said tape binding means, said member having a conical outer surface for guiding stripped tape from said eyes to a location immediately downstream of said guide means.

16. A method of laying dielectric optical waveguides into a filament to produce an optical cable, said filament having a surface defining a plurality of grooves, the grooves each having the form of a helix, each said helix changing hand along the filament, the method comprising feeding filament along the path, paying out dielectric optical waveguides from fixed stores distributed around said path, leading payed out dielectric optical waveguides from respective stores into respective grooves through guide means located radially outwardly of the path, and rotating the guide means first in one direction and subsequently in the opposite direction so that individual dielectric optical waveguides circumferentially follow respective ones of the filament grooves at the guide means, the improvement comprising maintaining the dielectric optical waveguides substantially free of longitudinal tension downstream of entry thereof into the guide means.

* * * * *